United States Patent [19]

Rae

[11] 4,151,827

[45] May 1, 1979

[54] COMBINED CAST FIREPLACE AND HEAT EXCHANGER

[76] Inventor: William J. Rae, P.O. Box 393, Bandera, Tex. 78003

[21] Appl. No.: 832,076

[22] Filed: Sep. 12, 1977

[51] Int. Cl.[2] ..... F24B 7/04

[52] U.S. Cl. ..... 126/121; 126/129; 126/131

[58] Field of Search ..... 126/120, 121, 131, 132, 126/129; 52/583, 587

[56] References Cited

U.S. PATENT DOCUMENTS

| | | | |
|---|---|---|---|
| 1,069,944 | 8/1913 | Haggard | 126/120 |
| 1,303,022 | 5/1919 | Brown | 52/587 |
| 1,702,096 | 2/1929 | Thompson | 52/587 |
| 2,158,041 | 5/1939 | Covert | 126/121 |
| 3,301,249 | 1/1967 | Hendricks | 126/120 |
| 3,460,525 | 8/1969 | Bryant | 126/120 |
| 3,866,595 | 2/1975 | Jones | 126/131 |
| 3,945,369 | 3/1976 | Adams et al. | 126/121 |

FOREIGN PATENT DOCUMENTS

| | | | |
|---|---|---|---|
| 2339215 | 2/1975 | Fed. Rep. of Germany | 126/120 |

*Primary Examiner*—John J. Camby
*Assistant Examiner*—Larry I. Schwartz
*Attorney, Agent, or Firm*—Willard J. Hodges, Jr.

[57] ABSTRACT

A cast fireplace comprising a heat exchanger as the rear wall component. The side walls, sloping top, and bottom plate are constructed of precast, refractory cement panels with the rear wall comprising a metal heat exchanger. Suitable ducting combined with a blower circulates air from the room through the heat exchanger and exhausts the heated air into the room to be heated. The efficiency of the fireplace is substantially enhanced by the combination extracting heat from the fire and projecting it into the room. The heat exchanger may be incorporated in the conventional brick fireplace; however, in the preferred embodiment precast, refractory cement slabs are utilized in the construction.

3 Claims, 6 Drawing Figures

COMBINED CAST FIREPLACE AND HEAT EXCHANGER

BACKGROUND OF THE INVENTION

1. Field of the Invention

This invention pertains to a fireplace construction including means for extracting a goodly portion of the heat from the fire and projecting it into the room. The device incorporates an electric driven blower circulating air from the room through a heat exchanger forming the rear wall component of the fireplace. The rear heat exchanger tends to reflect and radiate heat from its outer surface as well as heating the air circulating through the air space in the heat exchanger. The gist of this invention is the incorporation of the heat exchanger as the rear wall of the fireplace. The overall combination of the precast fireplace and heat exchanger is believed to be new.

2. Description of Prior Art

Prefabricated precast fireplaces have been in use for several years. Various means for circulating the air from the room through a fireplace adjacent to the fire have been developed. Some have been patented, such as U.S. Pat. Nos. 3,938,496 to Kempf and 3,955,553 to Soeffker.

SUMMARY OF THE INVENTION

In the preferred embodiment of this invention a precast fireplace constructed from reinforced refractory cement was employed. The interlocking precast slabs were utilized for the bottom plate, the sides, and the sloping top. A hollow, continuous slab-like heat exchanger comprises the rear wall of the fireplace. Suitable inlet and outlet ducting was employed in combination with a blower to extract heat from the fireplace and project the heat into a room to be heated. The heat exchanger may be installed in a conventional brick constructed fireplace; however, the preferred embodiment incorporated a combination of precast, prefab configuration.

BRIEF DESCRIPTION OF THE DRAWINGS

For a description of the construction and operation of the device of this invention reference is made to the attached drawings and the following detailed description of the preferred embodiment wherein identical reference numbers will be employed to refer to identical or equivalent components throughout the entire patent application.

DESCRIPTION OF THE PREFERRED EMBODIMENT

Figure 1:
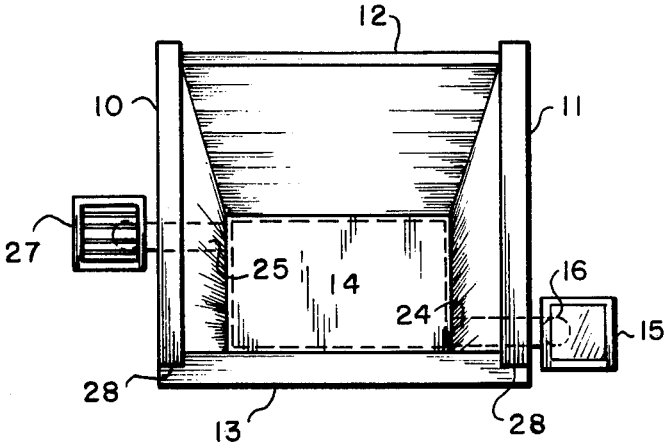
FIG. 1 is a front perspective view of the combined device in the relative arrangement of a fireplace.
Figure 2:
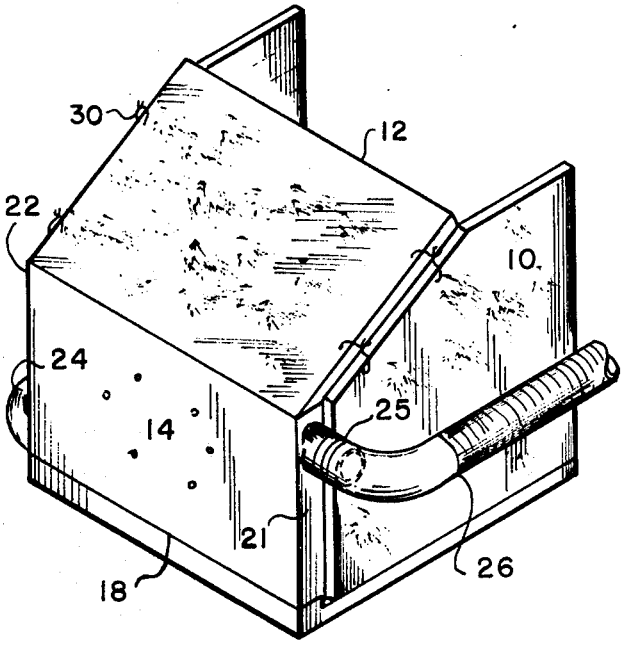
FIG. 2 is a rear perspective view of the combined device illustrating principally the rear of the heat exchanger component.
Figure 3:
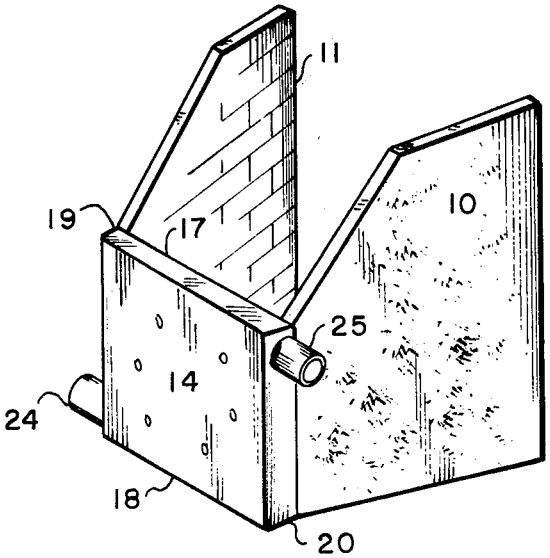
FIG. 3 is a fragmented rear perspective view of the device with the sloping top removed.
Figure 4:
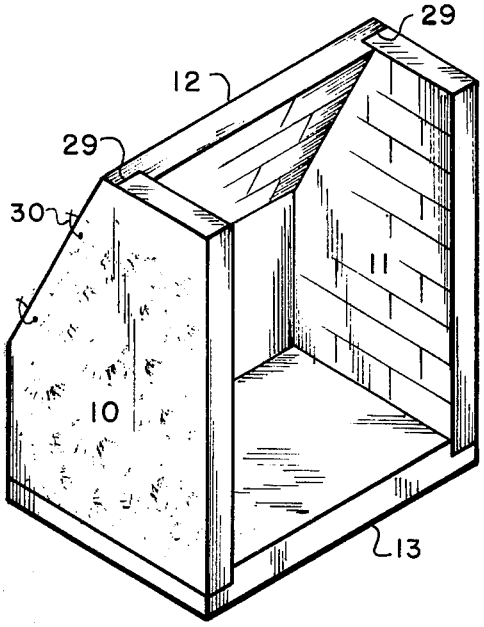
FIG. 4 is a front perspective view of the precast combination of the fireplace illustrating some details of construction.
Figure 5:
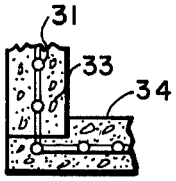
FIG. 5 is a sectional view of a bottom corner joint illustrating reinforcements and the mating of the bottom plate and of the side walls.
Figure 6:
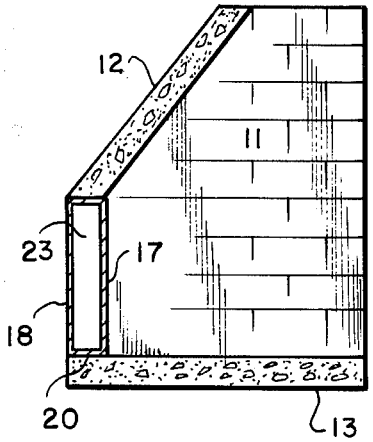
FIG. 6 is a sectional view through the fireplace and the heat exchanger comprising the rear wall of the fireplace.

The fire box components are cast from a refractory cement mixture which is heat resistant. Molds are constructed of the desired dimension for each of the component slabs or elements. Metal reinforcing mesh or rods are placed in the molds and the mixture of refractory cement and a light aggregate such as perlite or cinder is poured into the mold. The blocks may be subjected to vibrating if desired to obtain a block of increased density and more uniform texture; however, the natural stable curing of the blocks is satisfactory. For the construction and assembly of the various components of the preferred embodiment reference is made to the attached drawings. In the assembly of the blocks and the heat exchanger the cast components are placed in the position and assembled. The basic construction comprises a first side 10 and a second side 11 projecting vertically. The precast sloping top 12 is placed in position supported on first side 10 and second side 11. Sloping top 12 is precast with sloping top groove 29 which fits over first side 10 and second side 11. The structure of this invention could function satisfactorily with the components resting on a hearth or concrete slab base; however, in the preferred embodiment, a precast refractory cement bottom plate 13 was utilized intermeshing with first side 10 and second side 11. Bottom plate 13 for maximum stability and ease of assembly might be constructed with bottom plate grooves 28. To further facilitate assembly the reinforcing mesh 31 precast internal of first side 10, second side 11, sloping top 12 and bottom plate 13 may include assembly wires 30 which project out through the exterior of the various precast blocks. These assembly wires 30 are particularly useful in initial assembly of the blocks forming the fireplace. To enclose the rear of the fireplace, a heat exchanger 14 is placed in position. The heat exchanger 14 intermeshes with and fits under the rear edge of sloping top 12 and securely abuts the rear portion of first side 10 and second side 11. Heat exchanger 14 is connected to an electric powered blower 15 which is positioned adjacent to the base of the fireplace. Leading from blower 15 into the heat exchanger 14 is an inlet pipe 16. Heat exchanger 14 is constructed from heat resistant sheet metal such as $\frac{3}{8}$ to $\frac{1}{4}$ inch sheet steel. The heat exchanger 14 has a front wall 17 and a rear wall 18. To intermesh with sloping top 12 the heat exchanger 14 is enclosed at the top by sloping wall 19 interconnecting front wall 17 and rear wall 18. At the base of the heat exchanger 14 is a metal bottom plate 20 interconnecting front wall 17 and rear wall 18. To enclose the sides of the heat exchanger the first side plate 21 and second side plate 22 are constructed integral with or welded into position enclosing each end of the heat exchanger 14. This box-like structure results in an air space 23 in the center of the heat exchanger 14. Secured to or projecting into the heat exchanger 14 is inlet 24 which is connected to inlet pipe 16. Outlet 25 releases the heated air from the heat exchanger 14. Outlet 25 is connected to outlet pipe 26 which extends to an outlet grill 27. As previously stated, the precast concrete components forming the fireplace are constructed from a light aggregate 33 such a perlite or cinders. The mixture includes special heat resistant cement which is generally referred to in the trade as refractory cement 34.

OPERATION OF THE DEVICE

The operation of this combined cast fireplace and heat exchanger is rather self-evident. Blower 15 accepts cool air adjacent to the floor of the room or building and forces the cool air through inlet pipe 16 through air space 23 in the heat exchanger 14. The heated walls of the heat exchanger 14 heats the air as it passes through the exchanger 14. The air moves through outlet 25 into outlet pipe 26. Outlet pipe 26 may extend into one room only or it can project into an adjacent room or rooms. To disperse the heated air an outlet grill 27 may be employed having a vein-like construction to deflect the heated air into the room to be heated. One particular disadvantage of fireplaces as a means for heating a room has been the general inefficiency caused by virtually all of the heat other than radiant heat moving up the chimney with the smoke. The device of this invention overcomes, in a measure, this inefficient disadvantage by placing the heat exchanger 14 adjacent the fire and extracting a goodly portion of the heat from the fire. The device of this invention is particularly effective for heating cottages, small houses or rooms. Even though the building is equipped with central heating system the device of this invention can supplement the existing central heating or on occasions substitute for the central heating. Similar approaches to this problem have previously been attempted, some of which have been patented. To the best of the knowledge of your applicant he is the first to visualize and construct a fireplace with the rear wall comprising a heat exchanger and particularly when this rear wall is made part of a combination consisting of precast elements combined with the heat exchanger to comprise a fireplace and heat exchanger combination.

Modifications of this device and combination will be apparent to those skilled in the art from a study of the attached drawings and the detailed description. What is desired to be claimed is all modifications of the device not departing from the scope of equivalents as defined in the appended claims.

I claim:

1. A combined cast fireplace and heat exchanger comprising:

a. a precast bottom plate, b. a precast, first side wall projecting upward from said bottom plate, c. a precast, second side wall symmetrical with said first side wall projecting upward from said bottom plate, d. a precast, sloping top extending from said first side wall to said second side wall, e. a heat exchanger resting on and projecting upward from said bottom plate forming a composite integral structure with said first side wall, said second side wall and said sloping top, said heat exchanger constituting the rear wall of said fireplace enclosing the rear of the substantially pentagonal structure and including a power driven blower, a conduit interconnecting said blower and an inlet of said heat exchanger, and outlet means exiting from said heat exchanger.

2. The invention of claim 1 wherein said heat exchanger comprises:

a. a front wall extending the length, width and height of the rear of a fireplace, b. a rear wall of substantially identical dimensions as said front wall secured to said rear wall spaced from and parallel thereto, such spaced structure providing for, c. an air space between said front wall and said rear wall, d. said inlet comprising an opening into the said air space, and e. said outlet mean as comprising an opening leading from said air space.

3. The invention of claim 1 wherein said first side, said second side and said sloping top comprise:

a. internal metal reinforcing mesh, and b. assembly wires secured to said internal metal reinforcing mesh projecting external of said side plates, said assembly wires adapted to be attached to facilitate assembly of the device.

* * * * *